United States Patent [19]

Van Buuren

[11] Patent Number: 4,687,099

[45] Date of Patent: Aug. 18, 1987

[54] PACKAGE FOR COSMETIC PRODUCTS

[76] Inventor: Cornelis Van Buuren, Vlielandseweg 73, 2641 Ka Pijnacker, Netherlands

[21] Appl. No.: 814,354

[22] Filed: Dec. 27, 1985

[30] Foreign Application Priority Data

Dec. 28, 1984 [NL] Netherlands ..... 8403959

[51] Int. Cl.[4] ..... B65D 85/20

[52] U.S. Cl. ..... 206/362; 132/79 C; 132/88.7; 206/443

[58] Field of Search ..... 132/79 C, 88.7; 206/91–93, 96, 121, 131, 256, 267, 270, 361, 362, 362.1, 362.4, 371, 372, 379, 380, 382, 383, 443; 229/9–11

[56] References Cited

U.S. PATENT DOCUMENTS

| | | | |
|---|---|---|---|
| 1,143,627 | 6/1915 | Heretyk | 229/9 |
| 1,158,826 | 11/1915 | Mendelson | 229/11 |
| 1,675,496 | 7/1928 | Kasdan et al. | 132/79 C |
| 1,826,558 | 10/1931 | Matchett | 206/96 |
| 3,519,123 | 7/1970 | Nagle et al. | 229/9 |
| 4,167,231 | 9/1971 | Takahashi | 206/383 |
| 4,573,569 | 3/1986 | Parker | 206/362 |

FOREIGN PATENT DOCUMENTS

| | | | |
|---|---|---|---|
| 0735630 | 11/1932 | France | 229/11 |
| 0015273 | 9/1987 | Switzerland | 206/445 |
| 0016033 | of 1910 | United Kingdom | 206/45.26 |
| 0465003 | 4/1937 | United Kingdom | 206/380 |

*Primary Examiner*—Stephen Marcus
*Assistant Examiner*—Jimmy G. Foster
*Attorney, Agent, or Firm*—Flynn, Thiel, Boutell & Tanis

[57] ABSTRACT

Package for sticks having a head made of a cosmetic product, which package comprises a sliding tray with upstanding walls of which two upstanding opposite walls are near the middle, provided with an incision so that one part or member of the sliding tray can pivot with respect to the other member of the sliding tray, and in one of the members of the sliding tray is fastened means in which can be placed said sticks. The means in which the sticks can be fastened is a piece of double corrugated cardboard or a piece moulded out of plastic. The sliding tray is covered by means of a wrapper.

9 Claims, 7 Drawing Figures

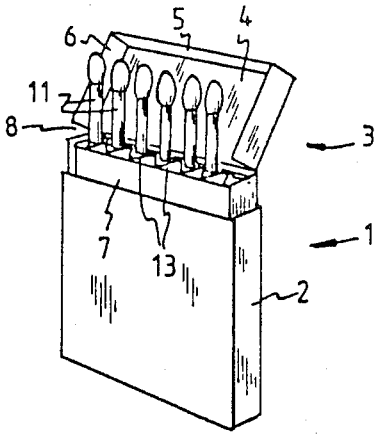
Fig: 1
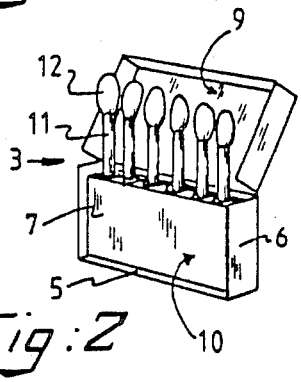
Fig: 2
Fig: 3
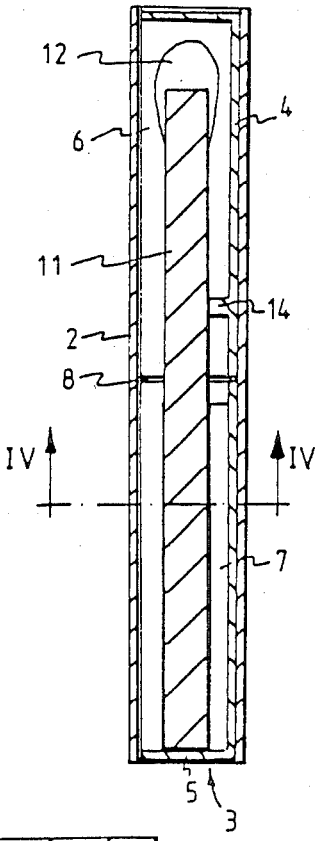
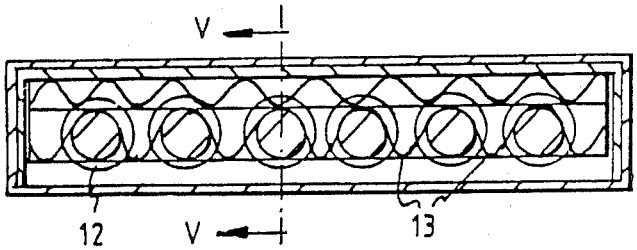
Fig: 4

Fig: 5
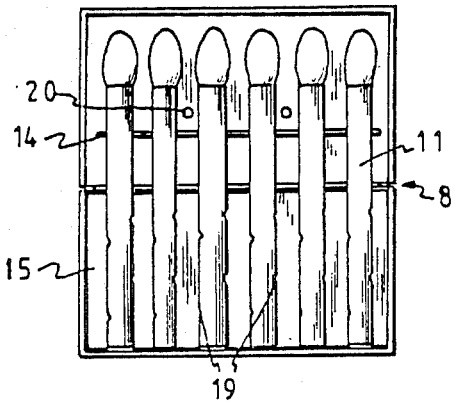
Fig: 6
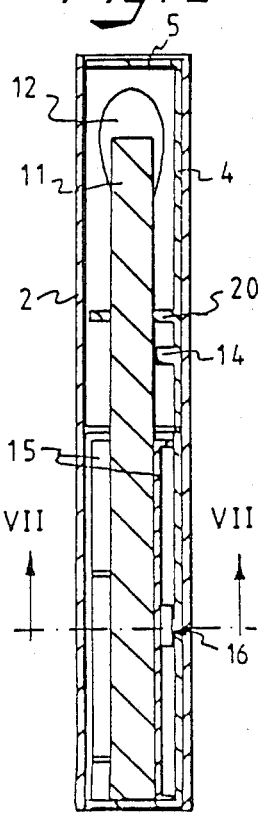
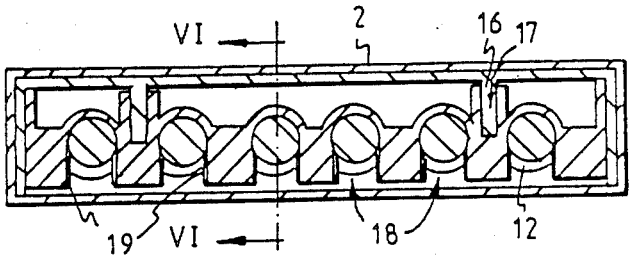
Fig: 7

PACKAGE FOR COSMETIC PRODUCTS

FIELD OF THE INVENTION

This invention relates to a package for sticks having at one end thereof a head of a cosmetic product, such as lipstick, rouge, face powder, eye shadow or the like.

BACKGROUND OF THE INVENTION

Sticks with a head of a cosmetic product have been on the market for a long time, and usually in one package a number of sticks are said together. A package for such sticks is described in the U.S. Pat. No. 2,775,247.

A principal object of this invention is to provide a package which can contain a number of sticks having thereon one cosmetic product or a combination of a number of cosmetic products and which is so economic to manufacture that the cost is very low compared to the cost of the sticks. A further object of the invention is to provide a package for sticks with a cosmetic head which can be carried in a lady's handbag without the cosmetic heads of the sticks being damaged. A still further object of the invention is to provide such a package which has small dimensions and which is light in weight.

SUMMARY OF THE INVENTION

The aim of the invention is attained with a package which includes a drawer or sliding tray having a bottom with upstanding walls, of which two opposite walls have near the middle an incision, slit or the like or are imparted in two so that one part of the bottom of the sliding tray with its upstanding walls can part with respect to a further part of the sliding tray. Fastened in the further part of the sliding tray is means in which can be placed one or more of said sticks, and the open upper side of the sliding tray can be covered by cover means. Such a package of small dimensions and light in weight and can be manufactured at low cost.

BRIEF DESCRIPTION OF THE DRAWINGS

The invention may be best understood by reference to the following description and the attached drawings, in which are presented as an example some possibilities of a package according to the invention. In the drawings show:

FIG. 1 is a side view of a cosmetic package according to the invention with a number of ticks each having a cosmetic head;

FIG. 2 is a side view of a sliding tray or drawer of the package as shown in FIG. 1;

FIG. 3 is a cross-sectional view of a package according to the invention taken along line III—III of FIG. 4;

FIG. 4 is a cross-sectional view according to the line IV—IV of the package shown in FIG. 3;

FIG. 5 is a top view of another embodiment of the sliding tray according to the invention;

FIG. 6 is a cross-sectional view of the package as shown in FIG. 5 and in a larger scale, according to the line VI—VI of FIG. 7; and FIG. 7 is a cross-sectional view of the package as shown in FIG. 5 according to the line VII—VII of FIG. 6.

DETAILED DESCRIPTION

In FIG. 1 a side view of the package 1 according to the invention is shown. The package 1 consists of a wrapper 2 in which a drawer or slidably tray 3 can be slideably pushed. The sliding tray 3 is shown in FIG. 3. The sliding tray 2 consists of a bottom 4 with upstanding walls 5, 6. In the sliding tray 3 a piece 7 of corrugated cardboard is fastened. Two of the opposite walls 6 of the sliding tray 3 are near the middle provided with an interruption defined by an incision, slit 8 or the like, through which one part or first member 9 of the sliding tray 3 can pivot with respect to the other part or second member 10 of the sliding tray 3. The sliding tray can also be parted in two parts which are more or less of the same dimensions, while the bottoms 4 of the two parts of the sliding tray are pivotally connected to each other by a hinge. The piece of corrugated carboard 7 is fastened in the smallest of the two members of the sliding tray, in this embodiment the second member 10, in such a way that the lower side of the piece 7 lays against the endwall 5 of the second member 10. A number of sticks 11 each with a head 12 of a cosmetic product are put in the openings between the ribs 13 of the piece of corrugated cardboard.

The FIGS. 3 and 4 show more in detail how the sticks are placed and held in the piece 7 of corrugated cardboard. In these figures is shown, in a larger scale, the same sliding tray 3 as shown in the FIGS. 1 and 2. The sliding tray 3 has a bottom 4 and upstanding walls 5 and 6. The piece 7 of corrugated cardboard is preferably a piece of double corrugated cardboard, so that when a stick 11 has been placed in the available openings or recesses between the ribs 13 of the corrugated cardboard, the head 12 containing the cosmetic product will not come in contact with the bottom 4 of the sliding tray 3. This, no part of the head of the cosmetic product of a stick 11 is smeared on the bottom 4 of the sliding tray 3 or remains behind on it. By the walls 5, 6 of the sliding tray 3 higher than the thickness of the pieces of corrugated cardboard, no part of the head 12 of a stick 11 will come in contact with the wrapper 2 when the sliding tray 3 is pushed therein or when afterwards, it is carried in a lady's handbag.

The dimensions of the piece 7 of corrugated cardboard are preferably chosen such that no more than half the length of the sticks 11 can be enclosed by the ribs 13 of the piece 7, so the sticks 11 can be easily taken out even if a number of sticks have been placed somewhat tightly in the package. Although the incisions 8 in the walls 6 are such that the two members 9 and 10 of the sliding tray 3 can pivot sufficiently for relative to each other so that the bottom 4 of the first member 9 can touch the heads 12 of the sticks 11, the bottom 4 of the sliding tray 3 is preferably provided with a rib or ledge 14. Such a ledge 14 makes sure that the heads 12 do not come in contact with the bottom 4.

The wrapper 2 is preferably made of paper or cardboard and can, for example, be printed with a special advertisement or another desired text. On the outside of one of the endwalls 5 of the sliding tray 3 the package can be provided with an indication of the cosmetic product the package contains. This package is also very suitable to contain a number of sticks, each having thereon a different cosmetic product.

The FIGS. 5, 6 and 7 show another possible embodiment of the package according to the invention. This embodiment of the package also comprises a wrapper 2 and a sliding tray 3 but instead of a piece of corrugated cardboard, a casting 15 is used. The casting 15 is made out of plastic, for example it can be a moulded part. In this embodiment of the casting 15 it is rectangular. The width of the plstic piece corresponds with the distance between the two walls 6 with the slits 8 so that it can be placed inside the second member of the sliding tray 3. The FIGS. 6 and 7 are enlarged cross-sectional views of the package.

On the bottom 4 of the second member 10 of the sliding tray are two cylindrical projections 16 which correspond to two holes 17 in the casting piece 15 so that the casting piece 15 is connected to the bottom 4. In the casting 15 are a number of recesses or grooves 18 having widths which correspond to the dimensions of the thickness of the sticks 11. The grooves are parallel to the walls 6 with the slits 8. At the inside of the grooves 18 are a number of small ribs 19 which are perpendicular to the longitudinal direction of the grooves 18 and which ensure that the sticks 11 will be better clamped inside the grooves 18. On the bottom of the first member 9 of the sliding tray 3 is moulded the ledge 14 and the two cylindrical projections 20 to prevent that the heads 12 of the sticks 11 from coming in contact with the package.

I claim:

1. A package comprising a plurality of elongate sticks, a wrapper having means defining an opening extending thereinto, and a tray which can be slidably moved into and out of said opening in said wrapper; wherein said tray includes a bottom wall having upstanding walls adjacent peripheral edges thereof, two of said upstanding walls being adjacent opposite peripheral edges of said bottom wall and each being divided by an interruption in a middle portion thereof into first and second portions, and wherein said tray includes first and second parts which each include a respective portion of said bottom wall, said tray further including means for facilitating pivotal movement of said first part with respect to said second part thereof; wherein said first part of said tray has support means located between said upstanding walls for removably supporting said sticks on said tray, each said stick having at one end thereof a head made of a cosmetic product, said support means having therein a plurality of elongate parallel recesses which can each removably receive an end of a respective said stick remote from said head thereof and which are spaced sufficiently from each other so that said heads of said sticks are free of engagement with each other, each said recess having a length approximately equal to half of a length of each said stick and each said stick having a width which is approximately the same as a width of the corresponding recess.

2. The package according to claim 1, wherein each said recess is an elongate groove which is open along the entire length thereof, each said groove having ribs therein which extend perpendicular to the lengthwise direction thereof.

3. The package according to claim 1, wherein said second part of said tray includes an elongate rib which projects outwardly from said bottom wall toward said sticks and which extends perpendicular to said sticks.

4. The package according to claim 3, wherein said second part of said tray includes an elongate cylindrical projection which projects outwardly from said bottom wall at a location spaced from said upstanding walls and in a direction toward said sticks, and wherein when said tray is fully disposed in said opening in said wrapper said first and second parts thereof are positioned so that said projection extends between and beyond two of said sticks perpendicular thereto and has an end remote from said bottom wall which is adjacent an inner surface of a wall of said wrapper.

5. The package according to claim 2, wherein said two upstanding walls having said interruptions therein are parallel, and wherein said support means for said sticks includes a molded casting which has a width substantially equal to the distance between and which is fixedly secured between said two upstanding walls, said casting having therein said parallel grooves.

6. The package according to claim 1, wherein said support means includes a piece of corrugated cardboard having therein a plurality of spaced corrugation ribs which extend lengthwise thereof, each said recess being the region between two said ribs which are adjacent, and said piece of corrugated cardboard having a length which is approximately half the length of each said stick.

7. The package according to claim 6, wherein said piece of corrugated cardboard is a piece of double corrugated cardboard, and wherein said upstanding walls project outwardly from said bottom wall a distance greater than the thickness of said piece of double corrugated cardboard.

8. The package according to claim 1, wherein said wrapping is a rectangular box which has relatively rigid walls and is open at one end.

9. The package according to claim 8, wherein said box is made of cardboard.

* * * * *